US012722253B2

(12) United States Patent
Moroz

(10) Patent No.: US 12,722,253 B2
(45) Date of Patent: Sep. 1, 2026

(54) TOOL SHARPENING SYSTEM

(71) Applicant: David Moroz, Lymon, SC (US)

(72) Inventor: David Moroz, Lymon, SC (US)

( * ) Notice: Subject to any disclaimer, the term of this patent is extended or adjusted under 35 U.S.C. 154(b) by 162 days.

(21) Appl. No.: 18/652,178

(22) Filed: May 1, 2024

(65) Prior Publication Data

US 2024/0367291 A1 Nov. 7, 2024

Related U.S. Application Data

(60) Provisional application No. 63/463,974, filed on May 4, 2023.

(51) Int. Cl.
*B24D 15/08* (2006.01)
*B24D 15/06* (2006.01)

(52) U.S. Cl.
CPC ..... *B24D 15/08* (2013.01); *B24D 15/06* (2013.01)

(58) Field of Classification Search
None
See application file for complete search history.

(56) References Cited

U.S. PATENT DOCUMENTS 1,026,623 A * 5/1912 Caswell ..... B24D 15/08 451/380
1,192,416 A 7/1916 Graves
1,239,494 A 9/1917 Lange
2,740,241 A * 4/1956 Mccubbin ..... B24B 41/066 451/371
3,755,970 A 9/1973 Parr
4,441,279 A 4/1984 Storm et al.
4,669,227 A * 6/1987 Treppner ..... B24B 53/12 33/537
4,733,501 A 3/1988 McLean
5,458,534 A 10/1995 Campione et al.
5,582,542 A 12/1996 Stein
(Continued)

FOREIGN PATENT DOCUMENTS

CN 204800523 U 11/2015
GB 795157 5/1958
(Continued)

OTHER PUBLICATIONS

U.S. Pat. No. 560,111 May 12, 1896 Salot.
U.S. Pat. No. 729,319 May 26, 1903 Fowler.

*Primary Examiner* — Hwei-Siu C Payer
(74) *Attorney, Agent, or Firm* — Kim and Lahey Law Firm, LLC; Seann P. Lahey

(57) ABSTRACT

An angle reference block including a series of angled end surfaces. Slots disposed in the body of said angle reference block, wherein each of said slots includes a stop member that extends upward from a bottom of the slot a given distance that is associated with a specific angle set point. A key being receivable in said slots to adjust the angle associated with said angled end surfaces, wherein each said slot designates a predefine angle for adjusting the angled end surfaces to a desired set angle when said key is disposed in a given said slot and placed on a level surface. A honing guide having a housing that rotatably carries a roller member. A flat top surface disposed on a top side of said housing. A gripping material disposed on said flat top surface for receiving and resisting movement of a blade disposed against said flat top surface.

20 Claims, 14 Drawing Sheets

(56) References Cited

U.S. PATENT DOCUMENTS

| | | | | |
|---|---|---|---|---|
| 5,810,649 | A | 9/1998 | Oar et al. | |
| 5,944,592 | A | 8/1999 | Hall et al. | |
| 6,129,616 | A | 10/2000 | Klotz | |
| 7,104,876 | B1 | 9/2006 | Lin | |
| 8,197,304 | B2 * | 6/2012 | Hummel | B24D 15/06 451/380 |
| 8,388,413 | B1 | 3/2013 | Dovel et al. | |
| 8,790,162 | B1 | 7/2014 | Dovel | |
| 9,039,494 | B1 | 5/2015 | Dovel | |
| 9,216,487 | B1 | 12/2015 | Dovel | |
| 9,221,144 | B2 | 12/2015 | Powell | |
| 9,289,874 | B1 | 3/2016 | Sabo | |
| 9,821,436 | B1 | 11/2017 | Smith | |
| 9,902,047 | B1 | 2/2018 | Juranitch et al. | |
| 10,744,614 | B1 | 8/2020 | Allison | |
| 10,759,017 | B2 | 9/2020 | Powell | |
| 11,529,710 | B2 | 12/2022 | Kedziora | |
| 2003/0134583 | A1 | 7/2003 | Gallegos et al. | |
| 2006/0057946 | A1 | 3/2006 | Evans | |
| 2006/0189263 | A1 * | 8/2006 | Evans | B24D 15/06 451/45 |
| 2006/0258271 | A1 | 11/2006 | Naples et al. | |
| 2007/0281594 | A1 | 12/2007 | Jones et al. | |
| 2008/0113591 | A1 | 5/2008 | Stanley | |
| 2009/0004956 | A1 | 1/2009 | Smith | |
| 2009/0318066 | A1 | 12/2009 | Clay | |
| 2014/0342644 | A1 | 11/2014 | Hasegawa | |
| 2015/0140909 | A1 | 5/2015 | Stanley | |
| 2015/0151408 | A1 | 6/2015 | Jhones | |
| 2016/0207160 | A1 | 7/2016 | Sabo | |
| 2017/0057041 | A1 | 3/2017 | Coyle | |
| 2017/0326703 | A1 | 11/2017 | McVeigh et al. | |
| 2020/0361061 | A1 | 11/2020 | Zachariasen | |
| 2020/0376629 | A1 | 12/2020 | Baker et al. | |
| 2024/0058923 | A1 * | 2/2024 | Klein | B24B 41/06 |
| 2024/0367291 | A1 * | 11/2024 | Moroz | B24D 15/08 |
| 2025/0375848 | A1 * | 12/2025 | Haber | B24B 33/10 |

FOREIGN PATENT DOCUMENTS

| | | | | |
|---|---|---|---|---|
| GB | 911900 | A * | 11/1962 | B24D 15/06 |
| GB | 1445422 | A * | 8/1976 | B24B 41/066 |
| GB | 2405608 | A | 3/2005 | |
| WO | 2007048165 | A1 | 5/2007 | |
| WO | 2021029518 | A1 | 2/2021 | |

* cited by examiner

TOOL SHARPENING SYSTEM

BACKGROUND OF THE INVENTION

1) Field of the Invention

The present invention relates to cutting tool sharpeners, and more particularly, to an angle reference block and honing guide for assisted freehand sharpening of woodworking hand tool blades at specific angles.

2) Description of Related Art

In the practice of building hand crafted fine furniture, the master craftsman relies heavily on the use of hand tools (bench chisels, hand planes, etc.) to create their pieces of furniture. To achieve the desired results from these tools, the blades must be precisely honed and polished to a razor-sharp cutting edge.

The process to putting a refined cutting edge on the blade typically involves using a flat surface of gritted material (sandpaper, sharpening stone, etc.) and honing the blade in several stages of coarseness (1000, 4000, 8000, 1600) until the desired cutting edge sharpness is achieved.

Blade geometry (angle of cutting edge) also plays a crucial part in the sharpening process of these blades. Lower angles (20-25 degrees) for soft woods, and steeper angles (30-35 degrees) for harder woods. It is pertinent that the exact angle be maintained through the sharpening process to achieve desired results when using the tool.

Depending on the desired finished angle of the cutting edge, a primary angle is rough ground approximately 5 degrees less than the target angle, and then hand honed to the desired finished angle using a series of flat sharpening surfaces working from coarse to fine grits until the desired result is achieved.

Sharpening these blade edges can be accomplished by two methods. The first is by free hand sharpening, which is considered to be the most efficient method, giving the sharpener the most control of the process. This freehand method involves holding the blade by hand, with no mechanical devices, at a precise angle and honing the blade through the various sharpening grits until a desired sharpness is reached. This method often takes much experience gathered over many years for an individual to become proficient at freehand sharpening, making it a difficult skill for the typical hobbyist woodworker to develop.

The second sharpening method is to use a honing guide. A honing guide is a sharpening aid constructed typically of a roller that incorporates a clamp to hold the blade at a given angle. The honing guide allows the person to hone the blade through the various grits of materials until sharpness is achieved. Although these products will hold the blade at the angle it is initially set at, it can be somewhat difficult to return the blade to the same exact position once removed from the guide. Another issue is most of these devices lack the ability to hold smaller chisels (smaller than ⅜" wide), and the geometry of other specialty blades typically do not fit the clamping device. A notable sacrifice the user makes in using this clamp type honing guide method is the level of control over the sharpening process. The rollers and other guide components are intended to resist movement other than at a straight forward and back or side to side direction of travel. These rollers on the guides are typically elongated, diminishing, or entirely preventing the user's ability to control the motion of the blade across the sharpening surface and how pressure is applied to the leading edge of the blade, for example, slightly rolling the blade left or right to apply increased pressure to a particular portion of the blade. This clamp type honing method is also a bit more labor intensive than the freehand method since it involves having to set the desired angle and clamp the blade in place repeatedly. Many of the clamp arrangement are overly complex, not easily adjustable, and often interfere with controlling the movement of the blade when sharpening.

Accordingly, it is an object of the present invention to provide a tool sharpening system that resolves the issues that are involved with both of the above noted sharpening methods when sharpening chisels, leaving the user the ability to sharpen the chisels cutting edge in an assisted freehand manner providing the accuracy of using a honing guide to maintain a proper angle without the hassles and limitations of a clamp arrangement or the many hours of experience required to achieve the freehand sharpening skill, and while also allowing for improved control over the how pressure is applied across portions of the blade edge during sharpening.

It is a further object of the present invention to provide a tool sharpening system that resolves the issues that are involved with both of the above noted sharpening methods when sharpening wider plane blades by providing a honing guide with an easy to use and infinitely adjustable blade clamp that does not interfere with controlling the movement of the blade when sharpening.

SUMMARY OF THE INVENTION

The above objectives are accomplished according to the present invention by providing a tool sharpening system comprising an angle reference block including a series of angled end surfaces; a series of slots disposed in the body of said angle reference block, wherein each of said slots includes a stop member that extends upward from a bottom of the slot a given distance that is associated with a specific angle set point; a key being receivable in said slots to adjust the angle associated with said angled end surfaces, wherein each said slot designates a predefine angle for adjusting the angled end surfaces to a desired set angle when said key is disposed in a given said slot and placed on a level surface; a honing guide having a housing that rotatably carries a roller member; a flat top surface disposed on a top side of said housing; a gripping material disposed on said flat top surface for receiving and resisting movement of a blade disposed against said flat top surface; whereby an assisted freehand sharpening of woodworking hand tool blades at specific angles is achieved.

In a further advantageous embodiment, the roller member comprises a roller ring.

In a further advantageous embodiment, said roller ring is carried in a raceway defined in said housing, and wherein a bottom portion of said housing further defines a section of said raceway and provides a finger brace against which a user's finger rest during use.

In a further advantageous embodiment, at least one bearing unit is disposed along a top side of said raceway and engages said roller ring.

In a further advantageous embodiment, a bearing access opening is disposed in said housing adjacent said at least one bearing unit that exposes a portion of the bearing unit for cleaning and oiling.

In a further advantageous embodiment, said roller ring includes a textured surface on the outer surface of the ring to help grip on a sharpening surface and facilitate rolling.

In a further advantageous embodiment, said roller ring includes a radiused outer surface to allow for lateral pivoting on a sharpening surface to help shift pressure to a given portion of the blade cutting edge during sharpening.

In a further advantageous embodiment, said housing includes a long side and a short side relative to a center axis extending through a diameter of said roller ring, wherein the cutting edge of the blade is positioned to extend outwardly from either said long side or said short side based on a given angle of sharpening.

In a further advantageous embodiment, a honing guide recess is defined in a body of said angle reference block that has a complementary shape to the exterior of said honing guide for receiving said honing guide when not in use; and, a key recess defined in the body of said angle reference block that has a complementary shape to the exterior of said key for receiving said key when not in use.

In a further advantageous embodiment, at least one magnet is carried in a magnet slot disposed in said key recess for engaging said key and resisting accidental removal of said key from said key recess.

In a further advantageous embodiment, a concaved arched bottom side is included in said housing for receiving a user's finger.

In a further advantageous embodiment, a pair of roller arms extend laterally outward below a horizontal plane of said flat top surface; wherein said roller member is rotatably carried between the roller arms; wherein an apex of the roller member is approximately level with said horizontal plane of said flat top surface; and, wherein the blade mounted to said honing guide is vertically spaced from the apex of said roller member by said gripping material disposed on said flat top surface.

In a further advantageous embodiment, said roller member comprises a cylindrically shaped roller.

In a further advantageous embodiment, a clamp is removably carried by said housing, said clamp includes at least one guide rod received in and extending through said at least one guide rod opening, wherein said guide rod extends laterally outward from said housing below said flat top surface; a first clamping arm carried by said at least one guide rod on a first side of said housing and movable along said guide rod; a second clamping arm carried by said at least one guide rod on a second side of said housing opposite said first side and movable along said guide rod; said first and the second clamping arms each including a securing arm portion extending at an inclined upward angle above a horizontal plane of said flat top surface; whereby a tool blade is receivable against said gripping material of said flat top surface and said clamping arms are movable alongside guide rods to engage said tool blade and press said tool blade downward against said gripping material on said flat top surface of said housing.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
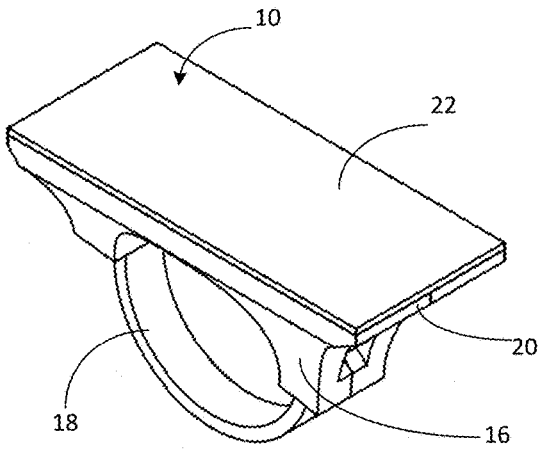
FIG. 1 shows top perspective view of the honing guide according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The present invention seeks to resolve the issues that are involved with the experience needed to freehand sharpen and the sort comings associated with clamp type honing guides. The present invention enables even an inexperienced user to sharpen in an assisted freehand manner providing the accuracy of using a honing guide to maintain a proper angle without the hassles and limitations of a clamp arrangement or the many hours of experience required to achieve the freehand sharpening skill, and while also allowing for improved control over how pressure is applied across portions of the blade edge during sharpening.

Referring to FIGS. 1-9, an example embodiment of a honing guide 10 for assisted freehand sharpening of woodworking hand tool blades, such as a chisel, at specific angles is shown. Referring to FIGS. 10-17, the honing guide 10 is used in combination with an angle reference block 12 to first set a desired angle at which the chisel blade edge is to be sharpened. Referring to FIG. 18, once the angle is set, the honing guide 10 is used to move the blade 13 over the sharpening surface 14, such as on a sharpening stone and the like, while applying pressure to the blade with the user's hand to maintain the proper angle and position on the honing guide 10. In a further embodiment shown in FIGS. 19*a*-19*h*, the honing guide 10 includes a clamp to assist in holding wider plane blades for sharpening. In a further embodiment shown in FIGS. 20*a*-20*h*, a low-profile honing guide 11 is disclosed that can include a clamp to assist in holding wider plane blades for sharpening. The low-profile honing guide 11 being better suited to achieving certain sharpening angles at 25° and below, while the honing guide 10 embodiment in FIGS. 1-9 and 19*a*-19*h* is best suited to achieving certain sharpening angles between 25°-65°.

Referring to FIGS. 1-9, in the example illustrated embodiment, honing guide 10 is shown in having a housing 16 that rotatably carries a roller member. In the illustrated embodiment, the roller member comprises a roller ring 18. A flat top surface 20 is disposed on a top side of housing 16. A gripping material 22 is disposed on flat top surface 20 to help grab and hold a blade 13 (see FIGS. 17*a*, 17*b* and 18) in position on honing guide 10. In an example embodiment, gripping material 22 is a rubber or silicone type material to resist movement of the blade on top surface 20 of housing 16.

Figure 2:
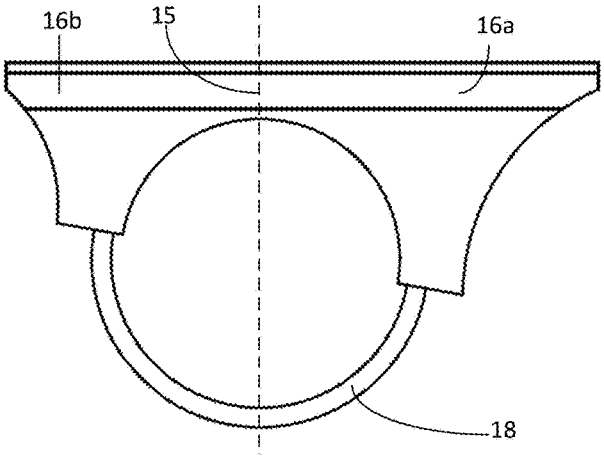
FIG. 2 shows a right side elevation view of the honing guide according to the present invention.
Figure 3:
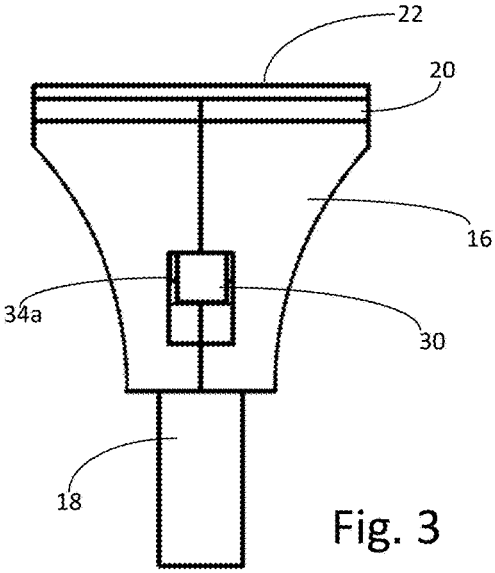
FIG. 3 shows a front elevation view of the honing guide according to the present invention.
Figure 4:
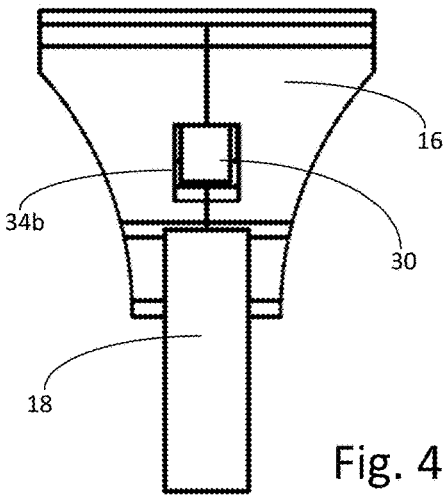
FIG. 4 shows a rear elevation view of the honing guide according to the present invention.
Figure 5:
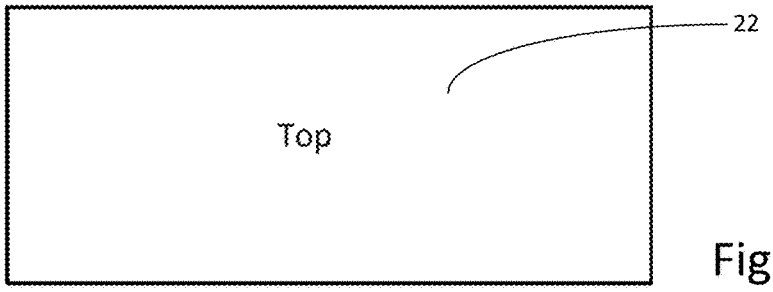
FIG. 5 shows a top plan view of the honing guide according to the present invention.
Figure 6:
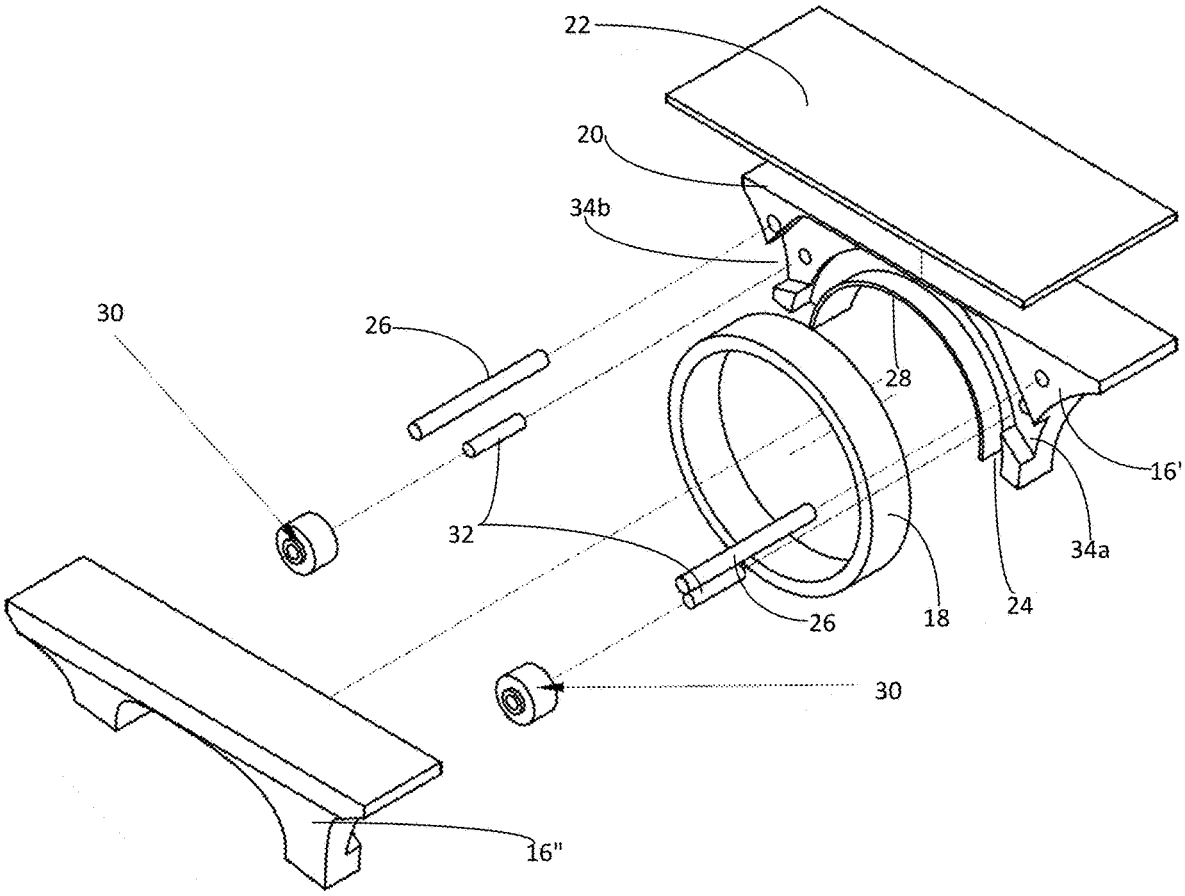
FIG. 6 shows an exploded perspective view of the honing guide according to the present invention.
Figure 7:
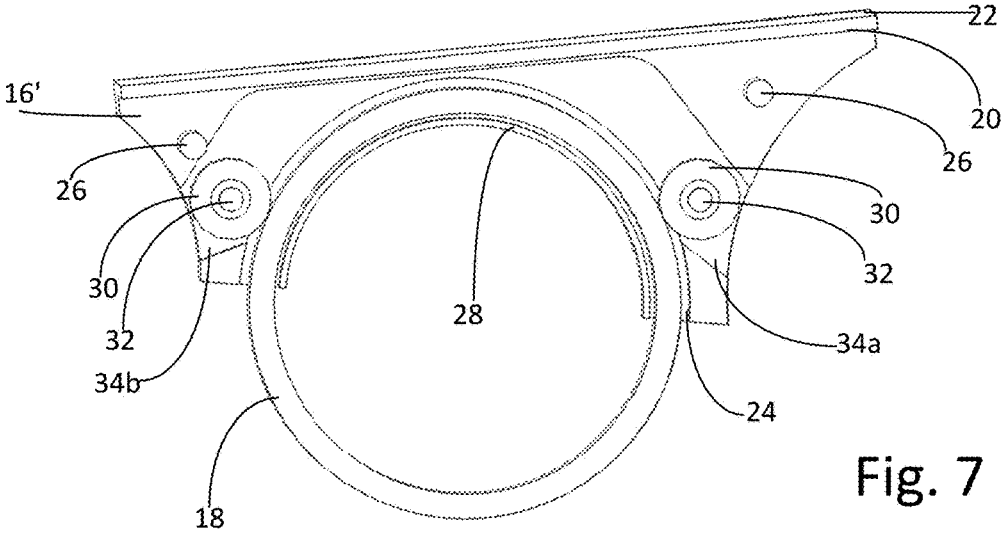
FIG. 7 shows a right side elevation cut-away view of the honing guide according to the present invention.
Figure 8:
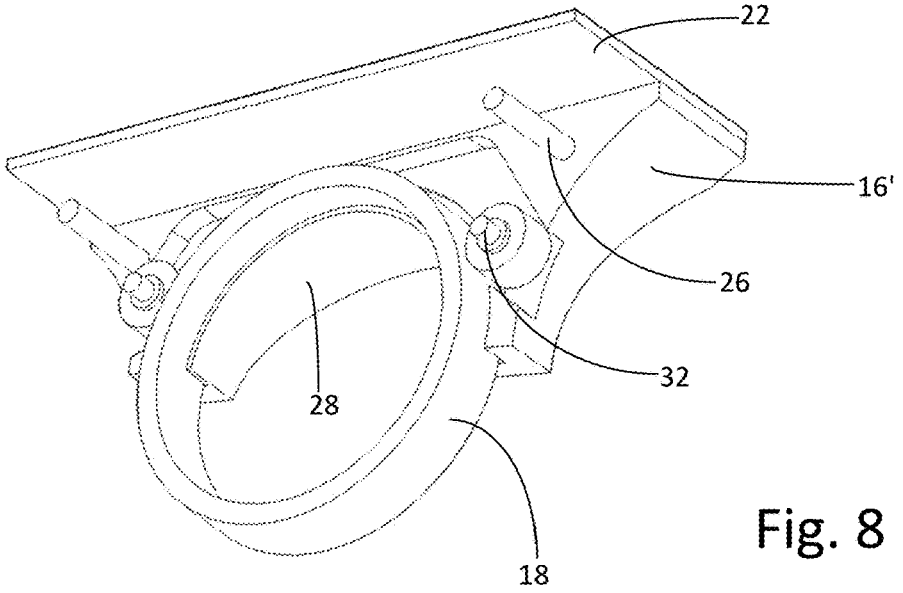
FIG. 8 shows a right side perspective cut-away view of the honing guide according to the present invention.
Figure 9:
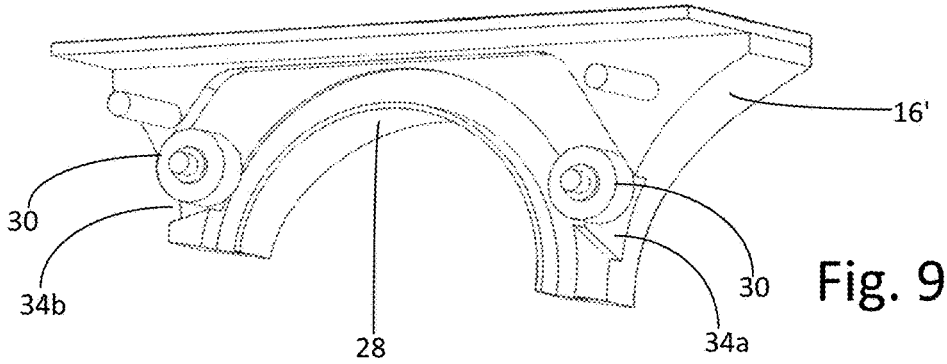
FIG. 9 shows a right side perspective cut-away view of the honing guide with the roller ring removed.

Referring to FIG. 2, in the example embodiment, housing 16 includes a long side 16*a* and a short side 16*b* relative to a center vertical axis 15 extending through the diameter of roller ring 18. Accordingly, long side 16*a* extends perpendicular to center axis 15 further than short side 16*b*. In one embodiment, roller ring 18 has a diameter of 1" with flat top surface 20 having an overall length of 1¾" for receiving the blade. In this arrangement, long side 16*a* has a length of about 1" and short side 16*b* has a length of about ¾" extending from center axis 15 of roller ring 18. In use, the blade to be sharpened is positioned on the flat top surface 20 and engaging gripping material 22 with the cutting edge of the chisel or blade extending from either the long side 16*a* or short side 16*b* depending on the desired angle of sharpening. For sharpening angles of 30° and less on the cutting edge, the blade is oriented with the cutting edge extending from the long side 16*a* for sharpening. For sharpening angles greater than 30°, the cutting edge of the blade is oriented extending from the short side 16*b* for sharpening.

Referring to FIGS. 6-9, in the illustrated embodiment, roller ring 18 is carried in a raceway 24 defined in housing 16. Housing 16 is shown having a first side 16' and a second side 16" that are interconnected by pins 26. Each of first side 16' and second side 16" include a portion of raceway 24 receiving roller ring 18 in a rotatable arrangement. A bottom portion 28 of each side of housing 16 further defines a section of raceway 24 and provides a finger brace against which the user's finger will rest.

Roller ring 18 further engages and rides on two bearing units 30 disposed along a top side of raceway 24 to help hold the roller ring 18 in place and facilitate a smooth rotation of roller ring 18 when moving along sharpening surface 14 as in FIG. 18. Bearing units 30 are carried on securing pins 32 mounted in housing 16. A pair of openings 34*a* and 34*b* are disposed in housing 16 adjacent each of bearing units 30 that expose the bearing units on each side of housing 16 and allow for periodic cleaning and oiling of the bearing units. In a further embodiment, roller ring 18 includes a knurling or other textured surface on the outer surface of the ring to help grip on the sharpening surface 14 and facilitate rolling instead of sliding. In a further embodiment, roller ring 18 includes a radiused outer surface to allow for lateral pivoting of the honing guide 10 to help shift pressure to a given portion of the blade cutting edge during sharpening.

Figure 10:
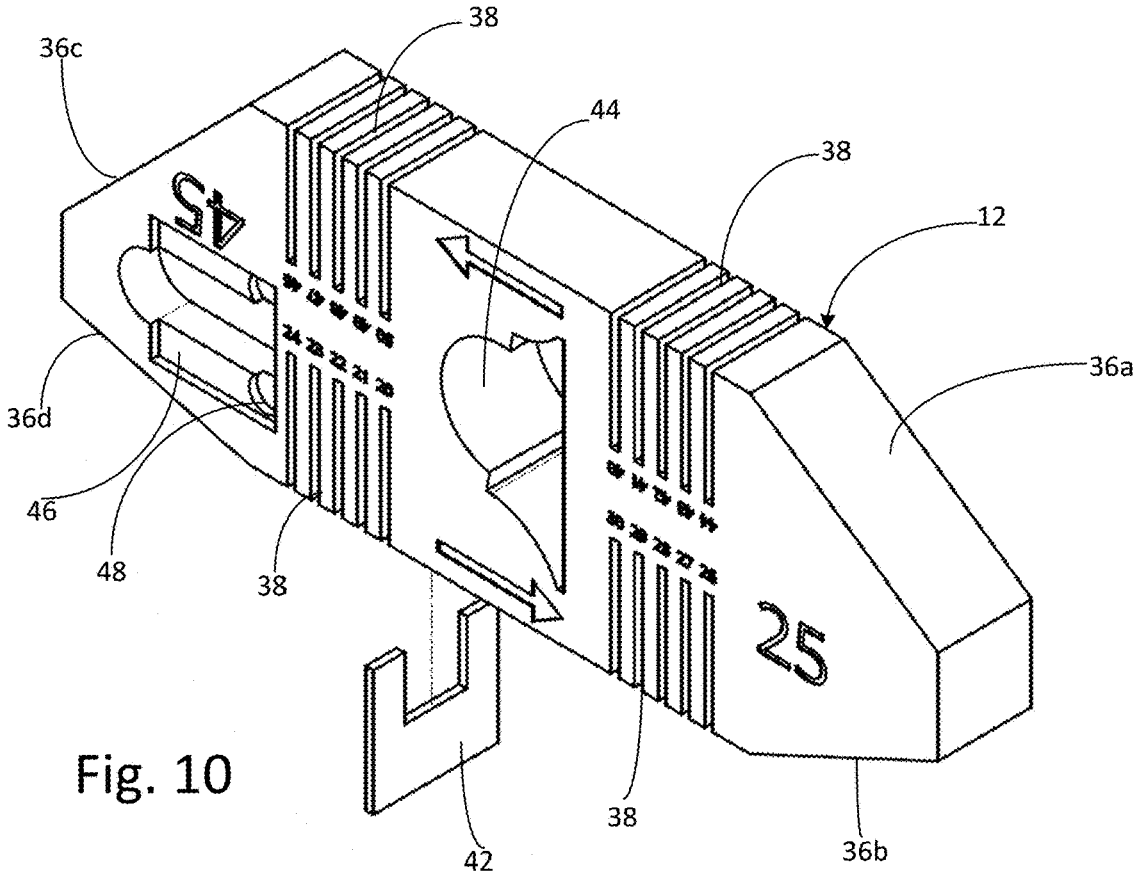
FIG. 10 shows a perspective exploded view of the angle reference block according to the present invention.
Figure 11:
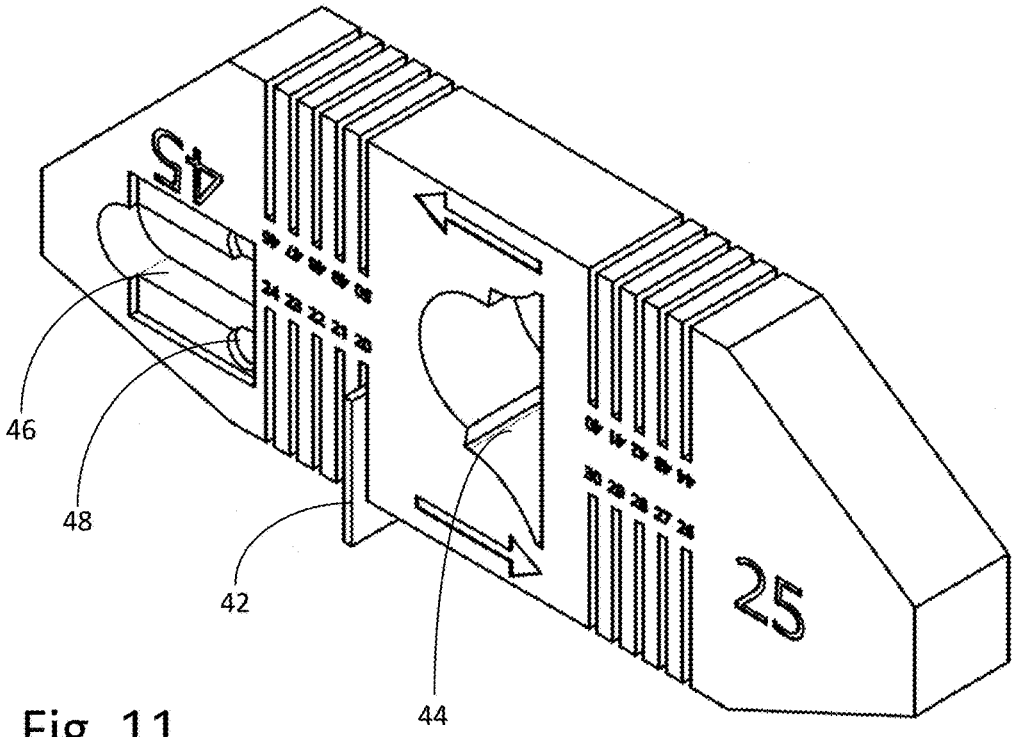
FIG. 11 shows a perspective view of the angle reference block according to the present invention.

Referring to FIGS. 10-16, an embodiment of an angle reference block 12 is shown for use in conjunction with honing guide 10 for setting the angle of the blade for sharpening. In the illustrated embodiment, angle reference block 12 includes a series of angled end surfaces 36*a*, 36*b*, 36*c* and 36*d* disposed at opposite ends, respectively. Each of angled end surfaces 36*a*, 36*b*, 36*c* and 36*d* has a predefined angle. A series of slots 38 are disposed in the body of angle reference block 12. Within each of slots 38 is a stop member 40 that extends upward from a bottom of the slot a given distance that is associated with a specific angle set point associated with angled end surfaces 36*a*, 36*b*, 36*c* and 36*d*. Each slot designates a predefine angle for adjusting the angled end surfaces 36*a*, 36*b*, 36*c* and 36*d* to a desired set angle. A key 42 is placed in a selected slot for achieving a referenced angle noted on the body of the angle reference block 12. As best shown in FIG. 11, key 42 slides into a given slot and engages stop member 40. A portion of key 42 extends outward from slot 38 when engaging stop member 40, which raises a portion of the angle reference block 12 when placed on a flat level surface to thereby change the angle associated with angled end surfaces 36*a*, 36*b*, 36*c* and 36*d*. For example, when angle reference block 12 is placed on a flat level surface, angled end surfaces 36*a*, 36*b*, 36*c* and 36*d* provide the predefined angle, which in the illustrated embodiment, is printed on the side of angle reference block 12 for a given angled end surfaces 36*a*, 36*b*, 36*c* and 36*d*. Inserting the key 42 into a given slot then changes the angle of angled end surfaces 36*a*, 36*b*, 36*c* and 36*d* to the angle associated with the noted slot among the series of slots 38.

Figure 12:
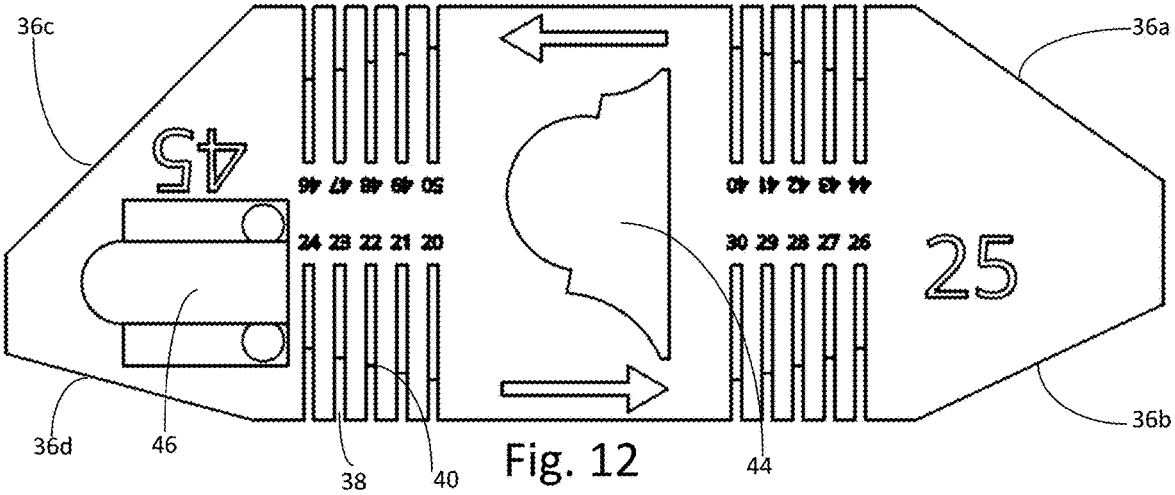
FIG. 12 shows a right side elevation view of the angle reference block according to the present invention.
Figure 13:
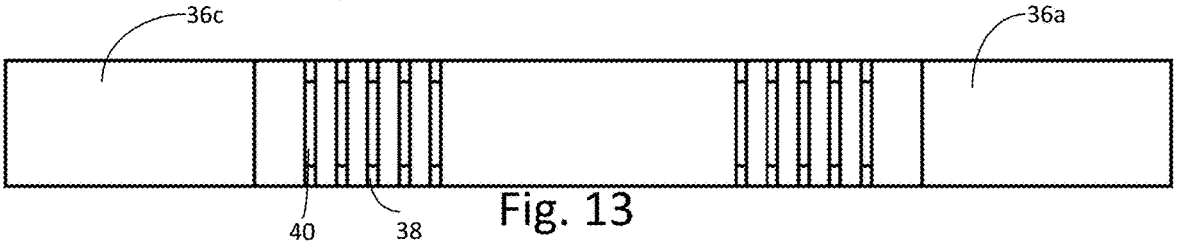
FIG. 13 shows a top plan view of the angle reference block according to the present invention.
Figure 14:
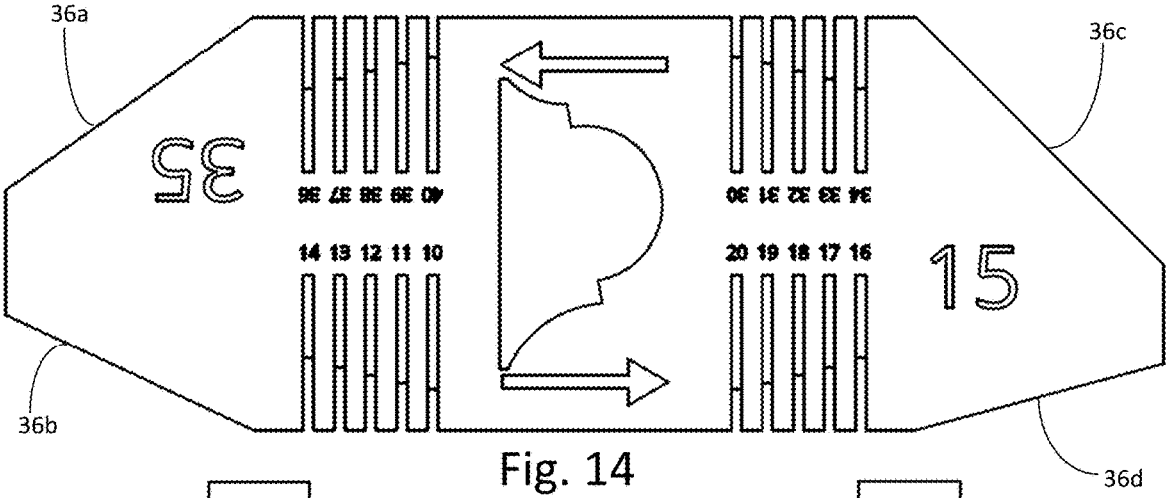
FIG. 14 shows a left side elevation view of the angle reference block according to the present invention.
Figure 15:
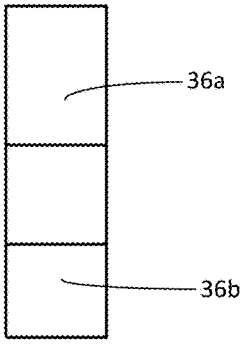
FIG. 15 shows a first end elevation view of the angle reference block according to the present invention.
Figure 16:
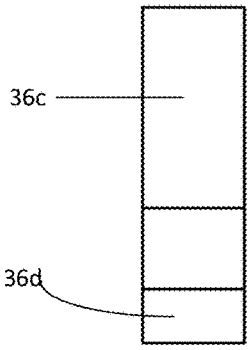
FIG. 16 shows a second end elevation view of the angle reference block according to the present invention.

Referring to FIGS. 10-12, in the illustrated embodiment, a honing guide recess 44 is defined in the body of angle reference block 12 that has a complementary shape to the exterior of honing guide 10. Honing guide 10 can then be received into honing guide recess 44 for storage when not in use. Additionally, a key recess 46 is also defined in the body of angle reference block 12 that has a complementary shape to the exterior of key 42. Key 42 can then be received into key recess 46 for storage when not in use. Preferably, at least one magnet is disposed in a magnet slot 48 disposed in key recess 46 for engaging key 42 and resisting accidental removal of key 42 from key recess 46.

Figure 17A:
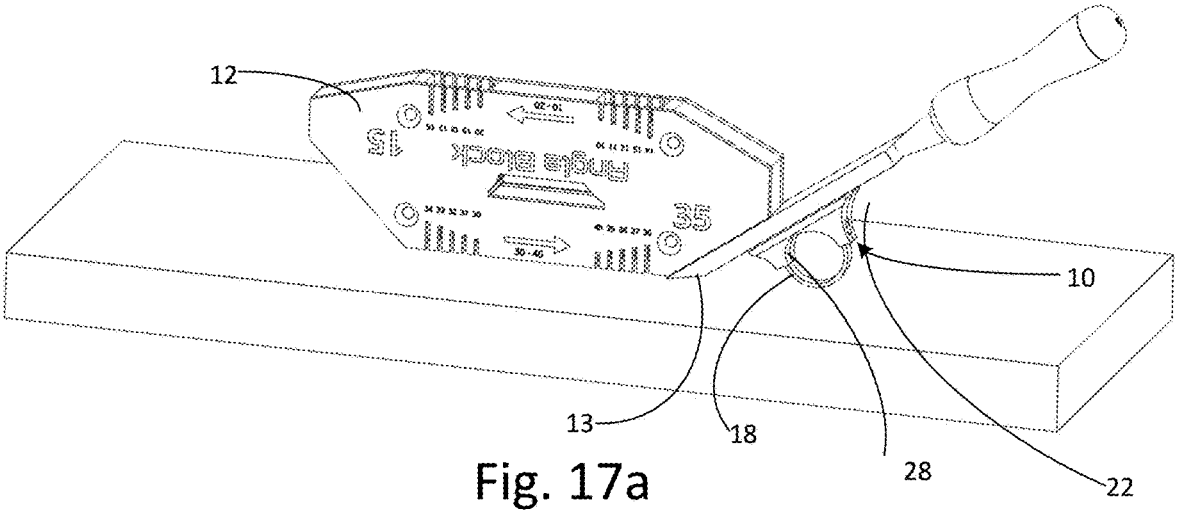
FIG. 17*a* shows a perspective view of a cutting tool positioned on the honing guide and engaging the angle reference block according to the present invention.
Figure 17B:
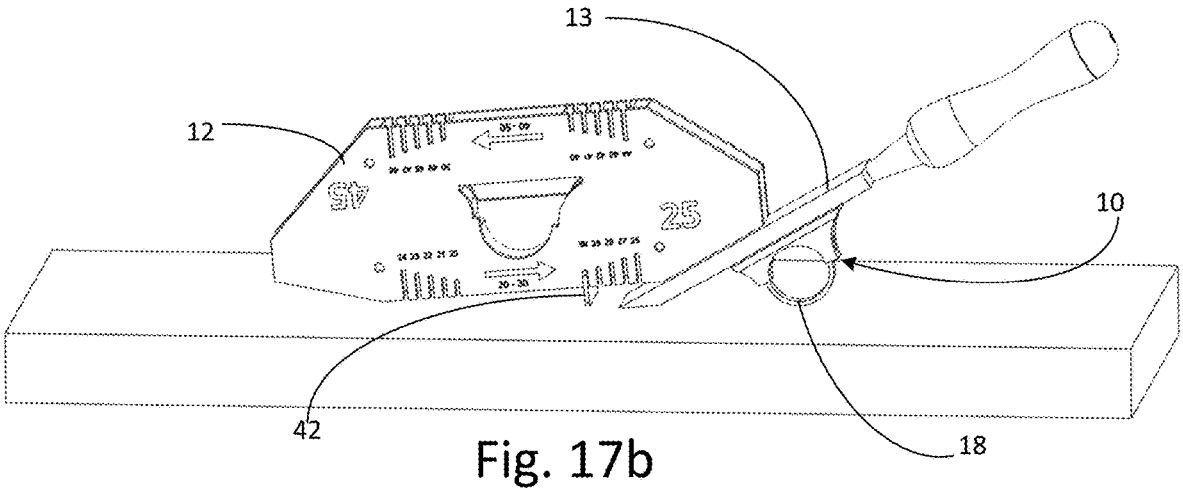
FIG. 17*b* shows a perspective view of a cutting tool positioned on the honing guide and engaging the angle reference block with the key set to a desired angle according to the present invention.
Figure 18:
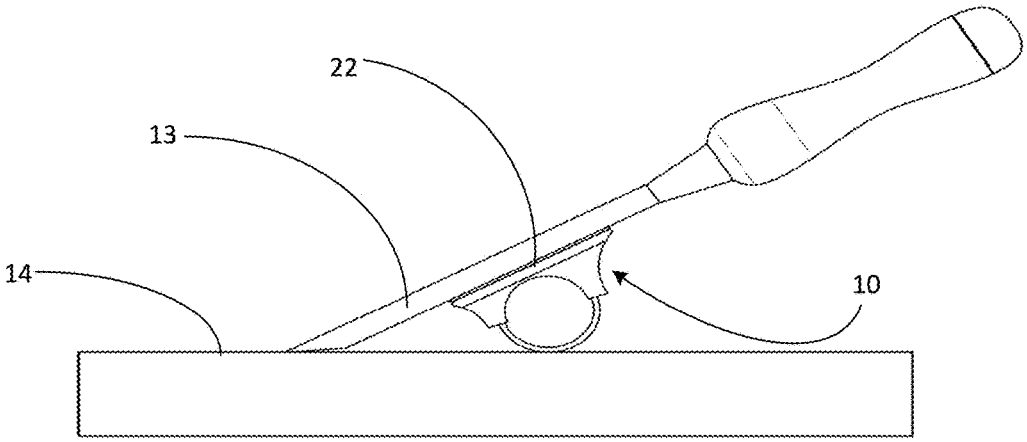
FIG. 18 shows a perspective view of a cutting tool positioned on the honing guide and engaging a sharpening stone according to the present invention.

Referring to FIGS. 17*a* and 17*b*, prior to sharpening, the user must first set the angle of the blade 13 on the honing guide 10. Using the honing guide 10 in conjunction with angle reference block 12 set at a specific angle as detailed herein above, the blade can be quickly and repeatedly set at the same exact angle with little effort. The blade is simply positioned against the desired angled end surfaces 36*a*, 36*b*, 36*c* and 36*d* (FIG. 12) and pressed flat against gripping material 22 on flat top surface 20 of honing guide 10. Since the blade is held to the guide by using only hand pressure, there is no need for mechanical adjusting and clamping for chisel type tools and narrow blades, which provides for an efficient and repeatable assisted freehand sharpening arrangement. Further, since the blade 13 is held against the honing guide 10 by only hand pressure, as a general rule, if the user can hold the blade in their hand, the honing guide of the present invention should be able to accommodate the tool for sharpening in the repeatable assisted freehand arrangement. With the exception of some short blades (spoke shave blades and knives) this sharpening system will work with almost any bench chisel, mortising chisel and hand plane blades.

Referring to FIG. 18, once the angle of the blade 13 is set on honing guide 10 as detailed above, the honing guide provides a single contact point on the sharpening surface 14 to maintain the referenced angle to be honed. This allows the user to traverse the blade across the sharpening surface in any fashion they feel comfortable with in order to achieve sharp (straight back and forth, skewed, etc.). This also allows the user to apply pressure along the leading edge of the blade or focused along any portion of the leading edge of the blade to provide the benefits of improved sharpening control.

Referring to FIGS. 19*a*-19*h*, honing guide 10 is shown including a clamp, designated generally as 50. The clamp is used to assist in securing wider flat plane blades (FIG. 19*h*) to the gripping material 22 on the flat top surface 20 of the honing guide 10. The clamp includes a pair of guide rods 52 that extend parallel to each other along a horizontal plane. The guide rods 52 extend through guide openings 54 in housing 16. This allows for removal or attachment of the clamp as needed for the specific blade to be sharpened.

A pair of clamping arms 56 are carried by guide rods 52 and disposed on opposite sides of housing 16 when the guide rods 52 are inserted through guide rod openings 54 in housing 16. Clamping arms 56 each include a base portion 58 having a pair of base openings 60 that extend through the base portion for receiving guide rods 52. Base portion 58 is slidably carried on the guide rods 52 for adjusting the position of the clamping arms 56 along the length of the guide rods 52. A securing arm 62 extends from each base portion 58. The securing arms 62 are arranged to extend towards each other on opposite sides of housing 16 for engaging and securing a blade against the top surface 20 of the housing 16. The securing arms 62 are arranged to extend at a slight upward angle. In the illustrated embodiment of FIGS. 19*a*-19*h*, a top surface 64 of the base portion 58 is angled upward. In this embodiment, the securing arms 62 are a flat plate secured to top surface 64 of the base portions 58 so that the plates extend at an upward angle. In the illustrated embodiment, the angle of the securing arms 62 is within a range of 5° to 15°, preferably approximately 10°. By angling the securing arms 62, a wide variety of blade thicknesses can be accepted into the clamp. Additionally, as the clamping arms 56 are push towards each other to securing a blade between them, the pressure on the top of the blade apply the angled securing arms 62, pulls the guide rods tight and causes them to flex and bow downwardly 52' like springs (as shown in FIG. 20*e*), which maintains pressure on the blade forcing it against the top surface 20 of housing 16 to hold the blade in place. When the sharpening process is complete, the user can then pull the clamping arms 56 apart using hand pressure to release the blade from the clamp 50 and honing guide 10.

Figure 19A:
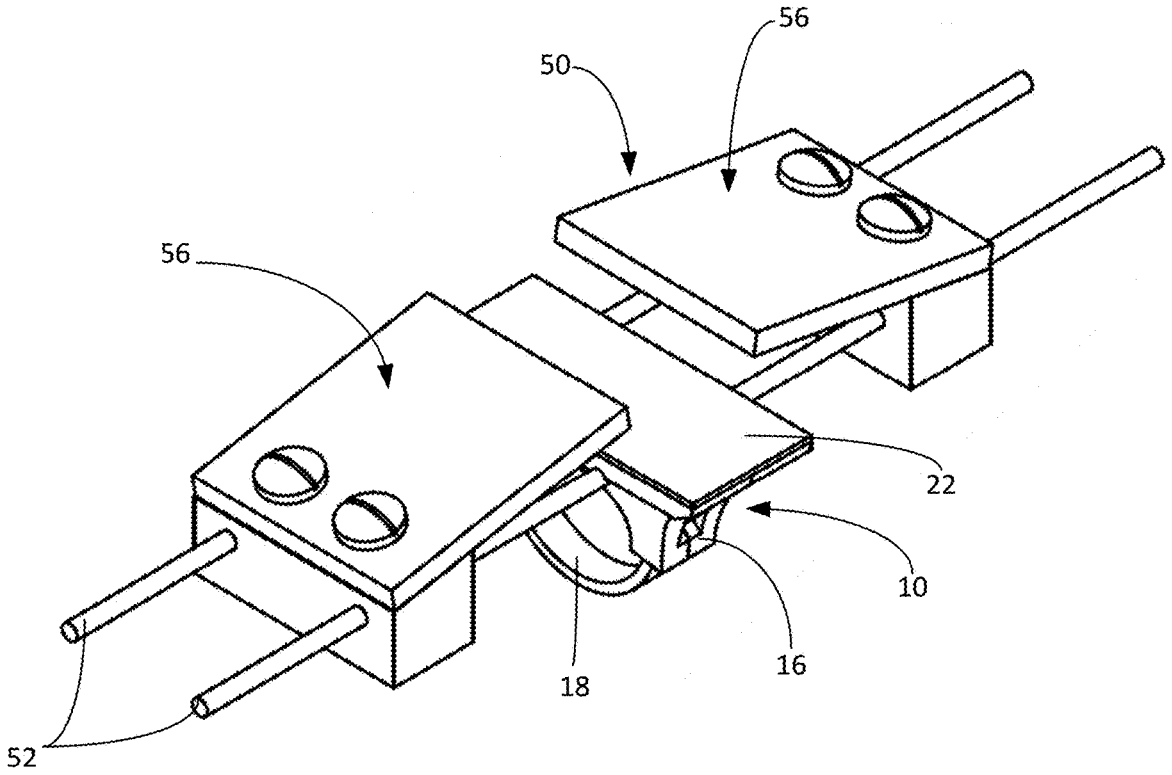
FIG. 19*a* shows a perspective view of the honing guide with a clamp in an engaging position according to the present invention.
Figure 19B:
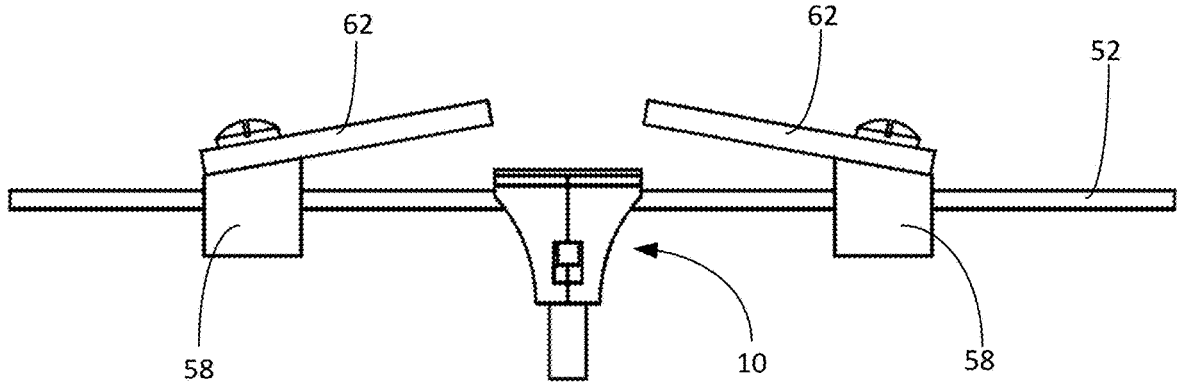
FIG. 19*b* shows a front view of the honing guide with a clamp in an engaging position according to the present invention.
Figure 19C:
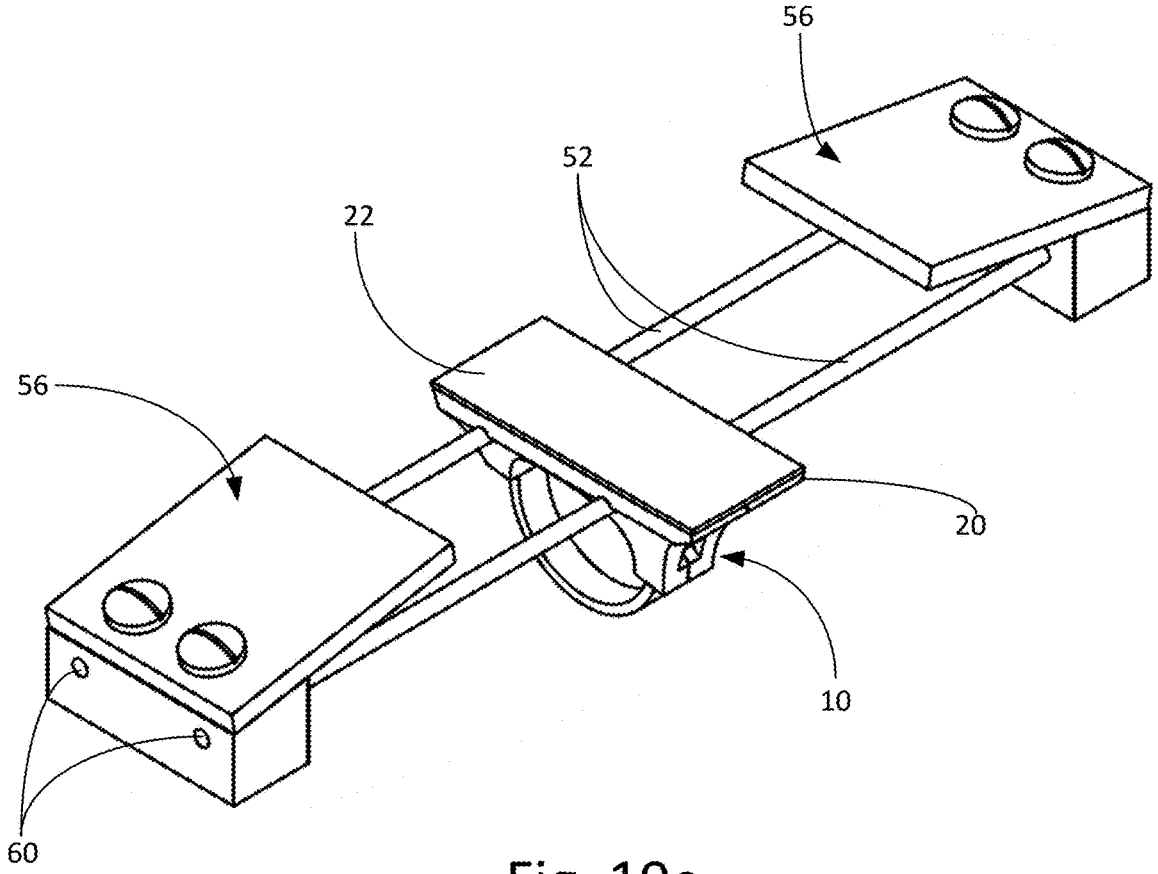
FIG. 19*c* shows a perspective view of the honing guide with a clamp in an extended position according to the present invention.
Figure 19D:
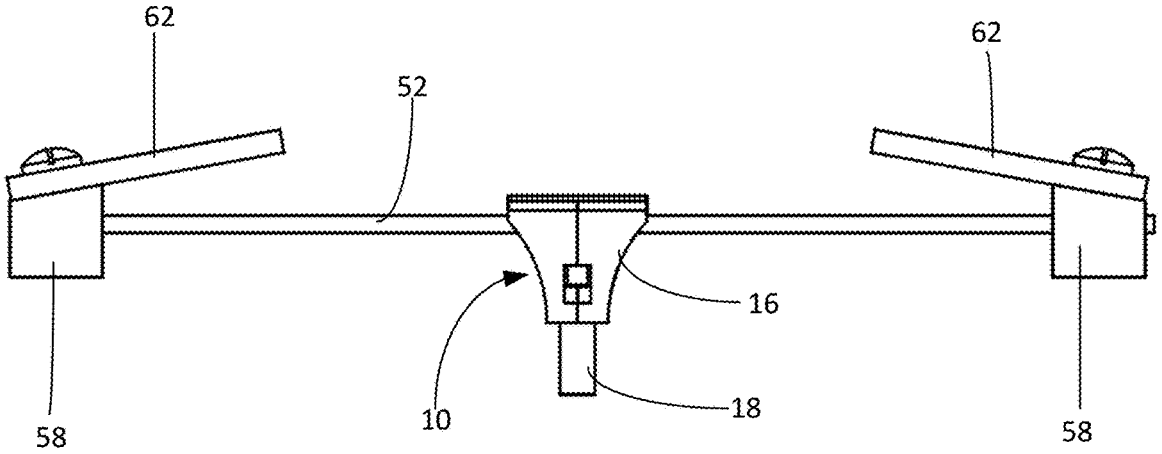
FIG. 19*d* shows a front view of the honing guide with a clamp in an extended position according to the present invention.
Figure 19E:
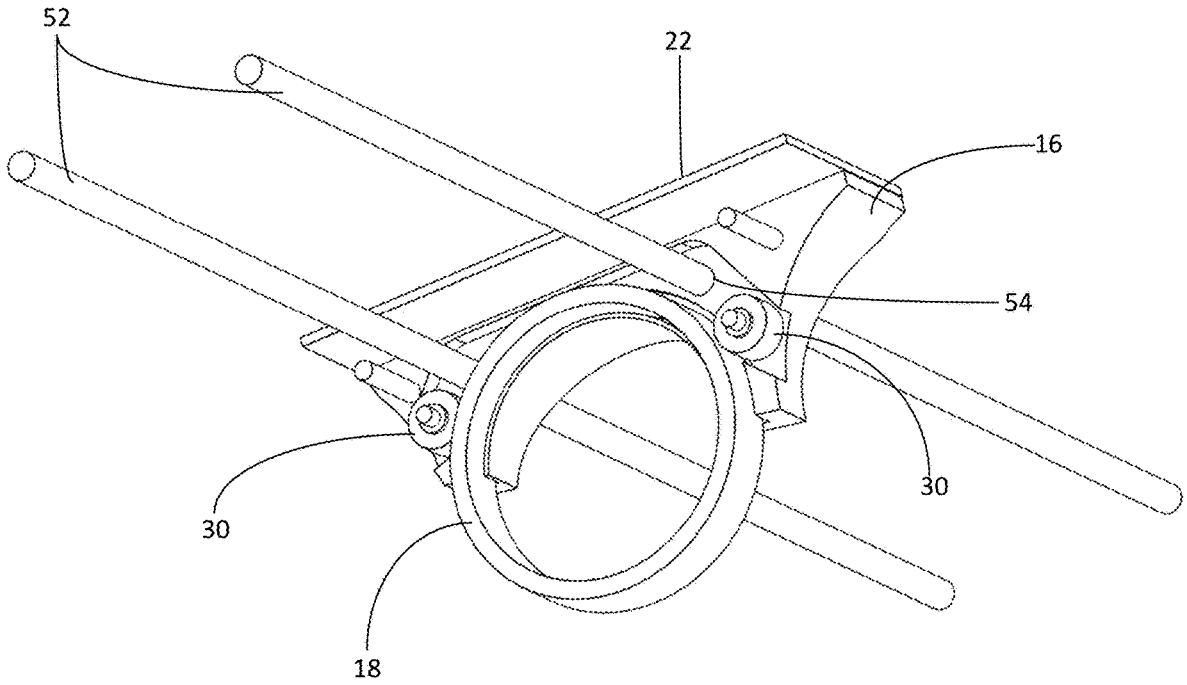
FIG. 19*e* shows a cut-away perspective view of the honing guide and clamp guide rods according to the present invention.
Figure 19F:
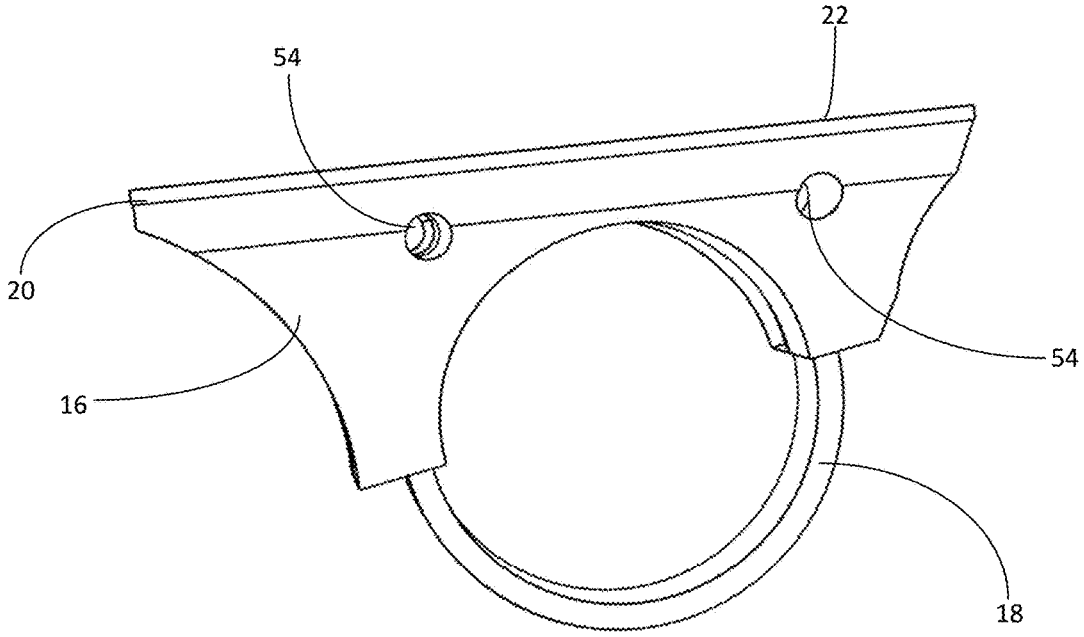
FIG. 19*f* shows a side view of the honing guide with the clamp guide rods removed.
Figure 19G:
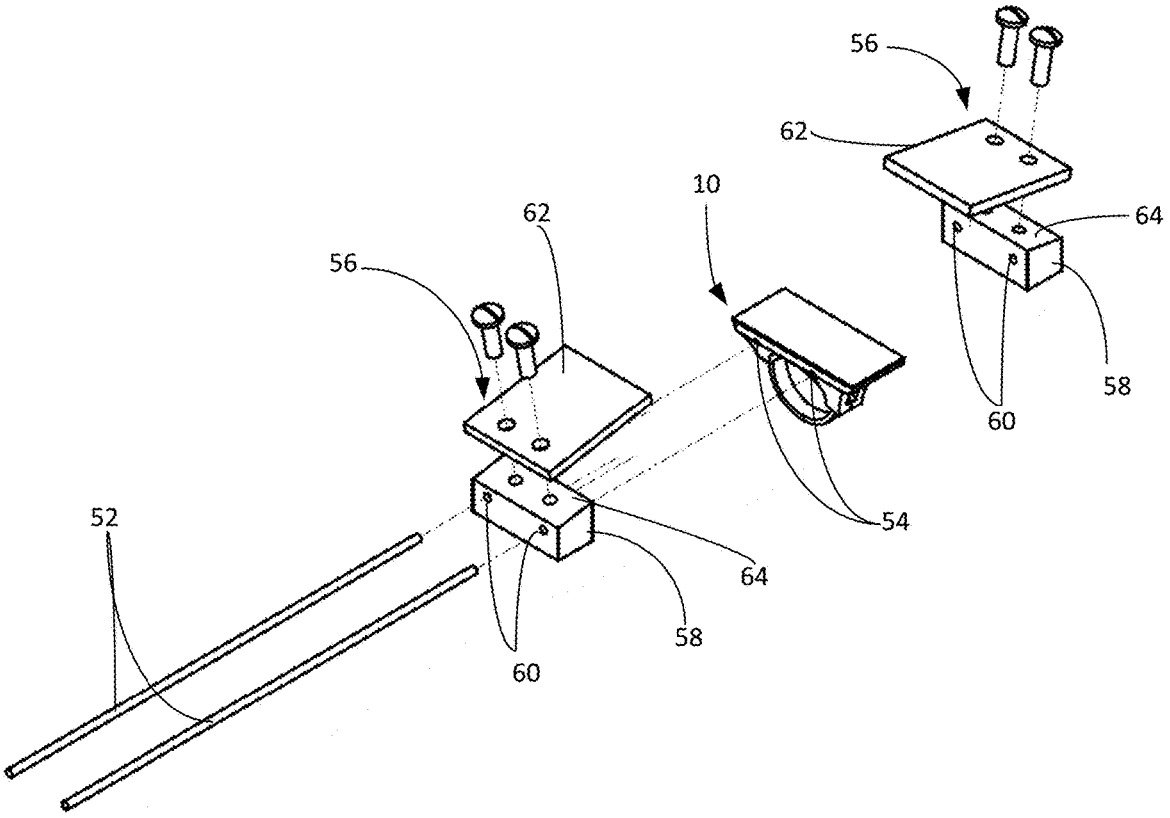
FIG. 19*g* shows an exploded view of the honing guide and clamp according to the present invention.
Figure 19H:
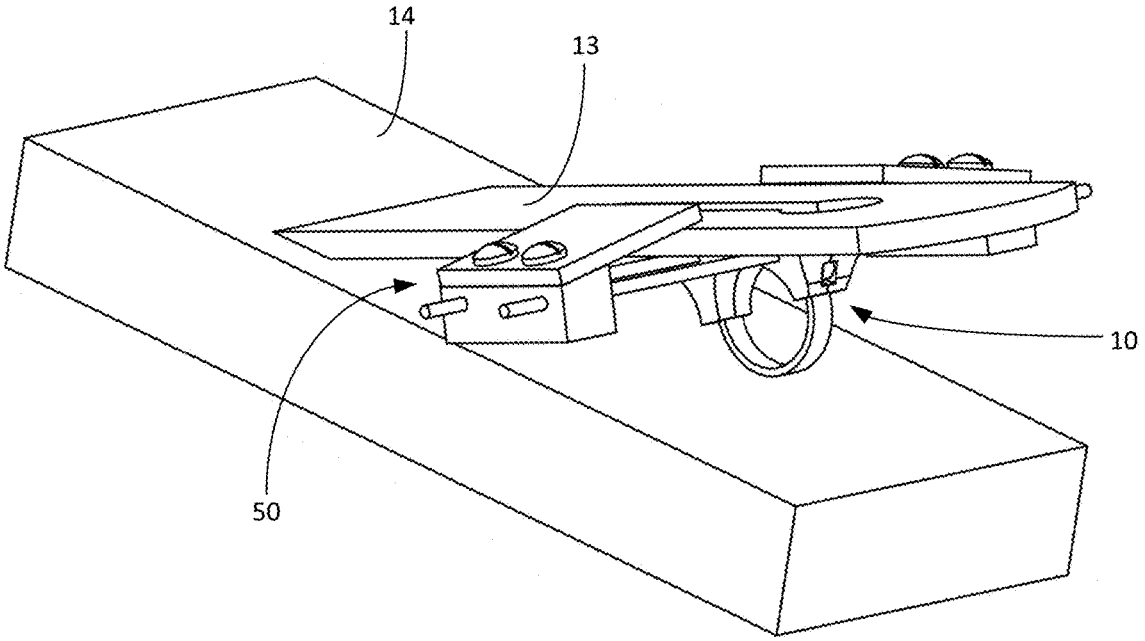
FIG. 19*h* shows a perspective view of a wide plane blade clamped to the honing guide and engaging a sharpening stone according to the present invention.
Figure 20A:
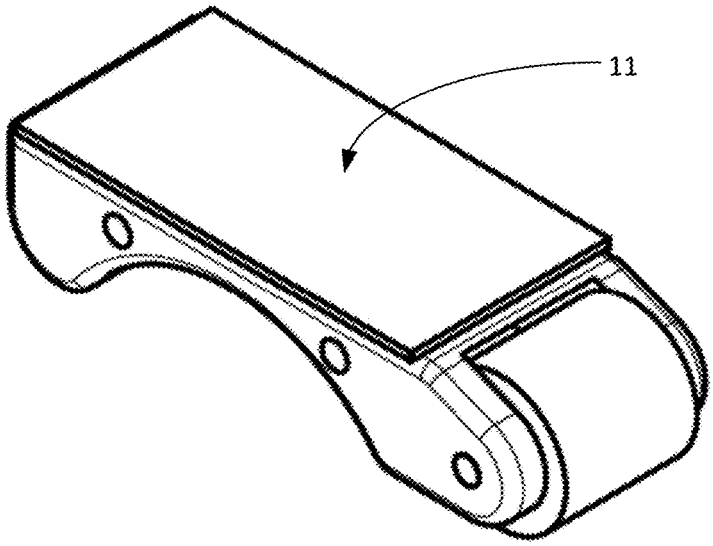
FIG. 20*a* shows a perspective view of low-profile honing guide according to the present invention.
Figure 20B:
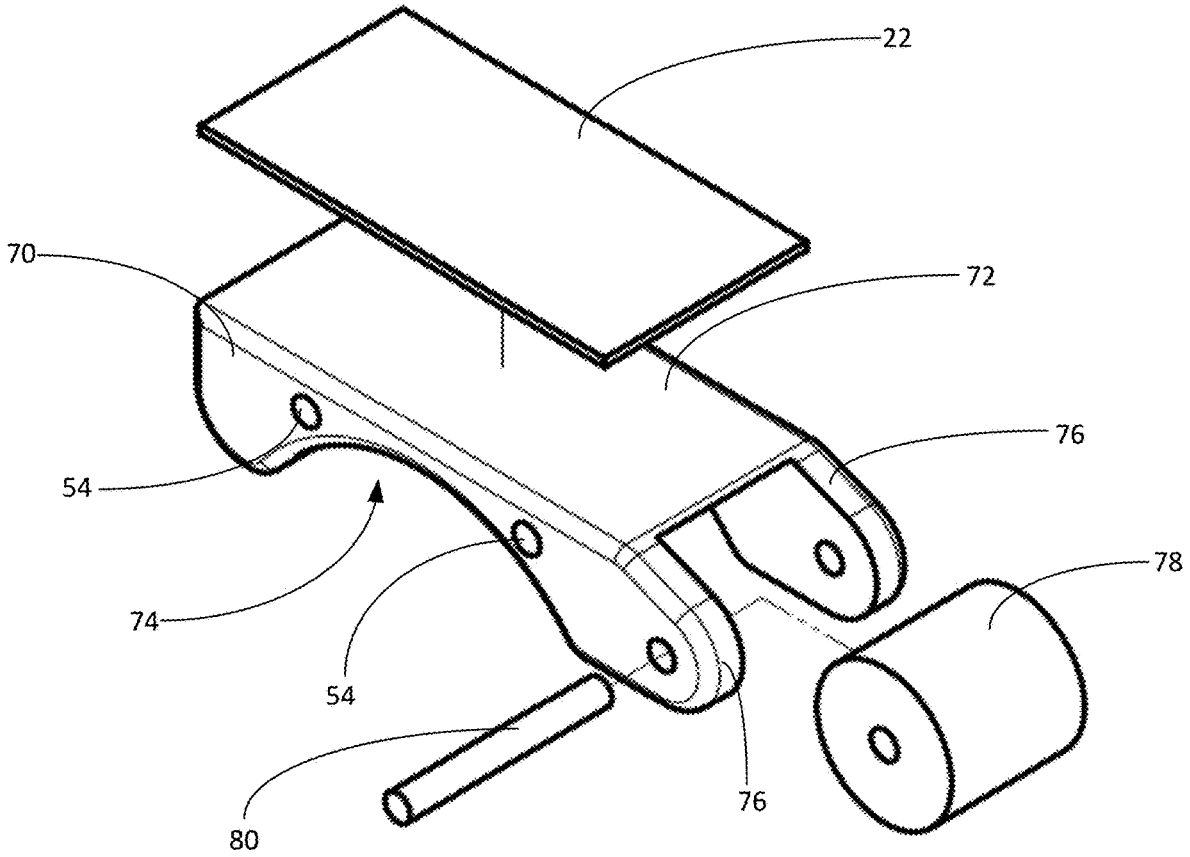
FIG. 20*b* shows an exploded perspective view of the low-profile honing guide according to the present invention.
Figure 20C:
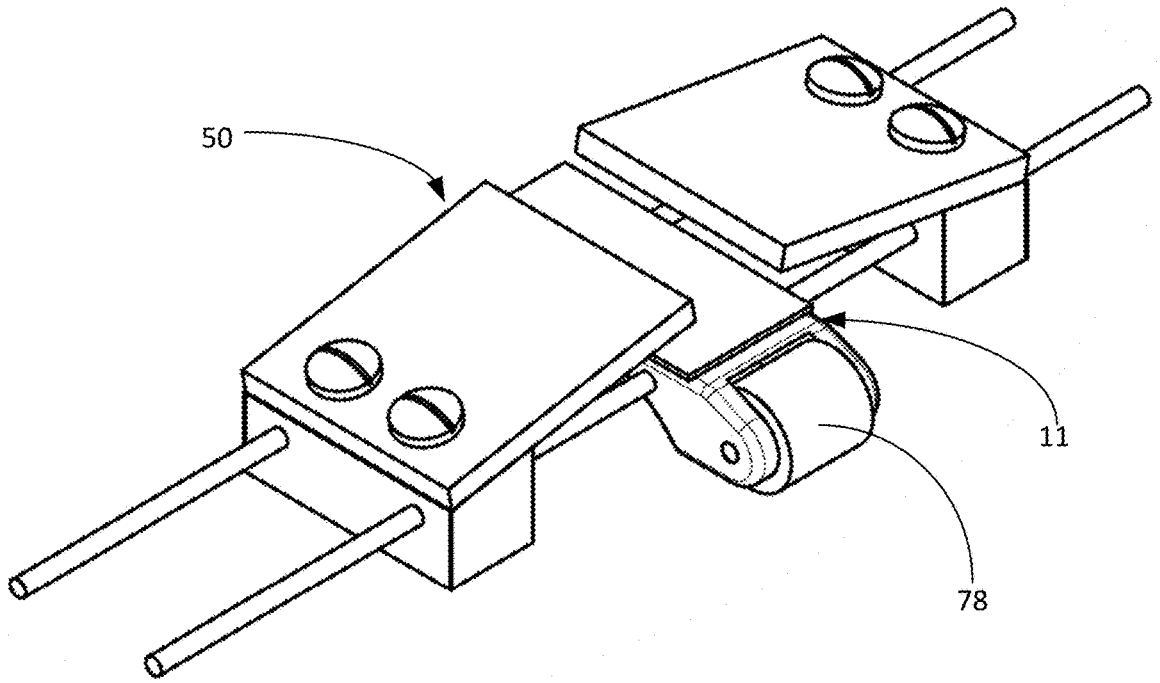
FIG. 20*c* shows a perspective view of the low-profile honing guide with a clamp in an engaging position according to the present invention.
Figure 20D:
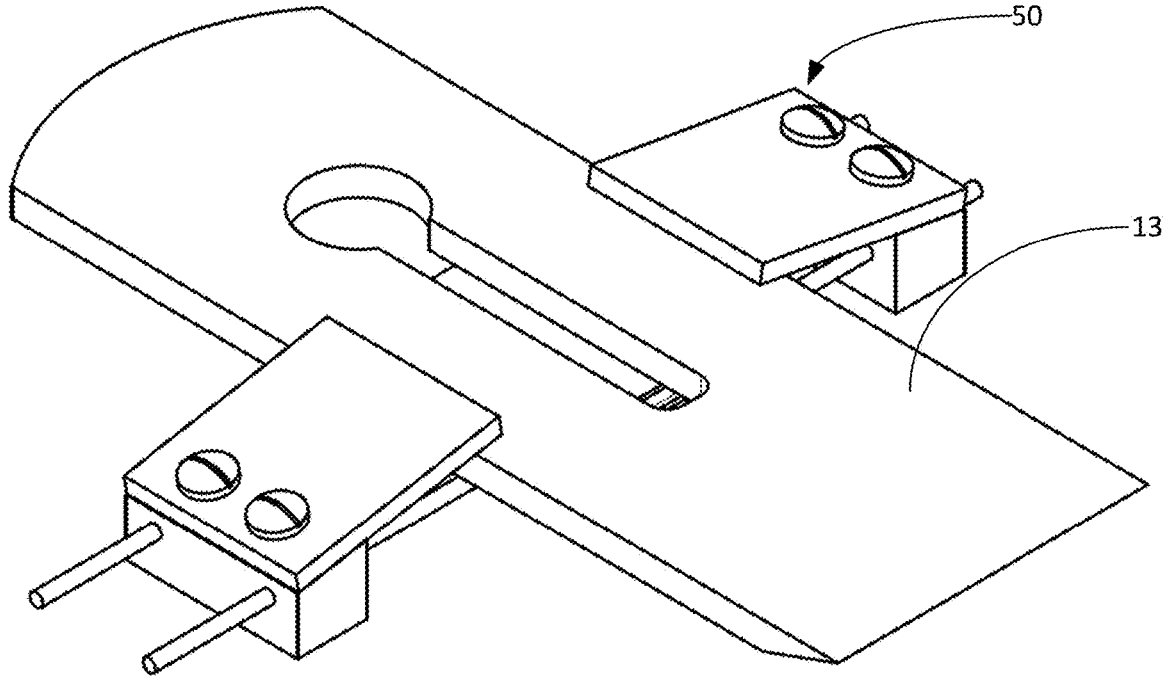
FIG. 20*d* shows a perspective view of a wide plane blade clamped to the low-profile honing guide according to the present invention.
Figure 20E:
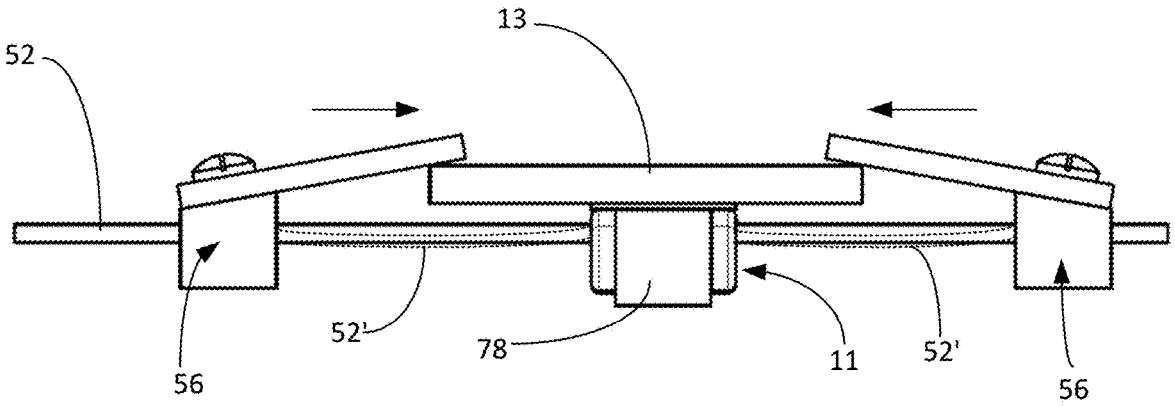
FIG. 20*e* shows a front view of the wide plane blade clamped to the low-profile honing guide according to the present invention.

As shown in FIGS. 19*a* and 19*b*, the clamping arms 56 are positioned closer together in an engaging position for securing a blade to the housing 16. As shown FIGS. 19*c* and 19*d*, the clamping arms 56 are positioned farther part in an extended position for releasing or inserting a blade. Accordingly, by sliding the clamping arms 56 along guide rods 52, a wide variety of blade sizes can be accommodated.

Referring to FIGS. 20*a*-20*f*, a low-profile honing guide 11 is shown. The low-profile honing guide 11 is designed to better assist in sharpening blades at angles below 25°. Same as the honing guide 10 described above, this further embodiment of a low-profile honing guide 11 is designed to use only hand pressure to secure the tool/blade to the low-profile honing guide 11 for the sharpening process, eliminating a mechanical means of attaching the low-profile honing guide to the tool/blade.

Figure 20F:
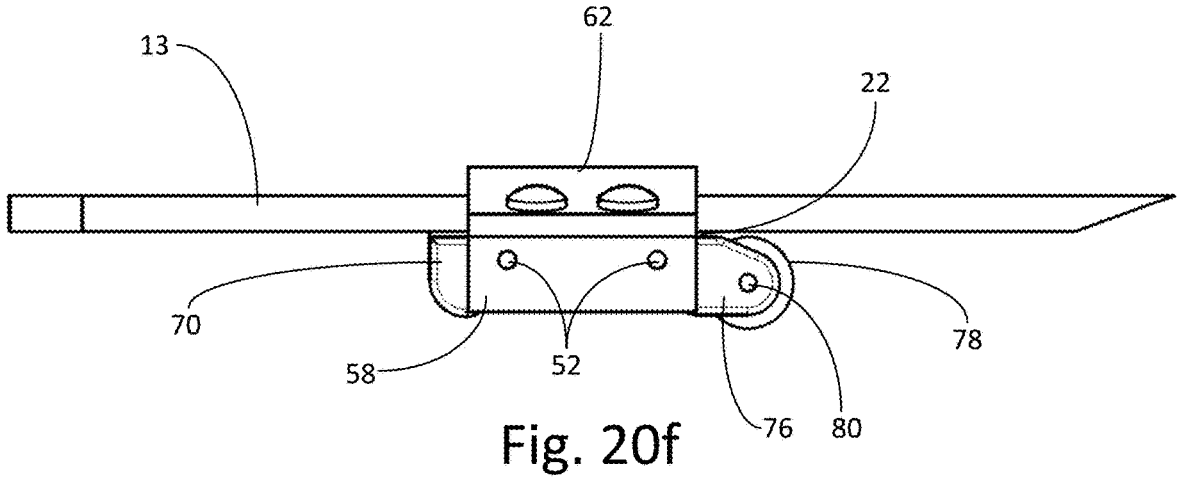
FIG. 20*f* shows a side view of the wide plane blade clamped to the low-profile honing guide according to the present invention.

In the illustrated embodiment, low-profile honing guide 11 includes a housing 70 with a flat top surface 72. A gripping material 22 is disposed on flat top surface 72 to help grab and hold a blade 13 (see FIGS. 20*d*-20*f*) in position on low-profile honing guide 11. In an example embodiment, gripping material 22 is a rubber or silicone type material to resist movement of the blade on top surface 72 of housing 70. A concaved arched bottom side 74 is included in housing 70 for receiving a user's finger to help grab and control the low-profile honing guide 11. A pair of roller arms 76 extend laterally outward just below the horizontal plane of the flat top surface 72. A roller member 78 is rotatably carried between the roller arms 76 on a rod 80 that extends between the two roller arms 76. In the illustrated embodiment, roller member 78 comprises a cylindrical roller. As best shown in FIGS. 20*e* and 20*f*, an apex of the cylindrical roller 78 is approximately level with the horizontal plane of the flat top surface 72. A blade mounted to the low-profile honing guide 11 is vertically spaced from the apex of cylindrical roller 78 and the top surface 72 by gripping material 22 disposed on flat top surface 72.

Housing 70 further includes guide rod openings 54 for receiving guide rods 52 of the clamp in the same manner as detailed herein above for honing guide 10. As shown in FIGS. 20*c*-20*g*, the clamp 50 is mounted to low-profile honing guide 11 to assist with wider flat plane blades. Both honing guide 10 and low-profile honing guide 11 work very well for use in sharpening wider flat blades such as plane blades, but these type blades can be a challenge to hold using just the honing guide 10 or low-profile honing guide 11 due to the width of the blade. The clamp 50 is designed to work with either honing guide 10 or low-profile honing guide 11 to secure it to the blade.

Figure 20G:
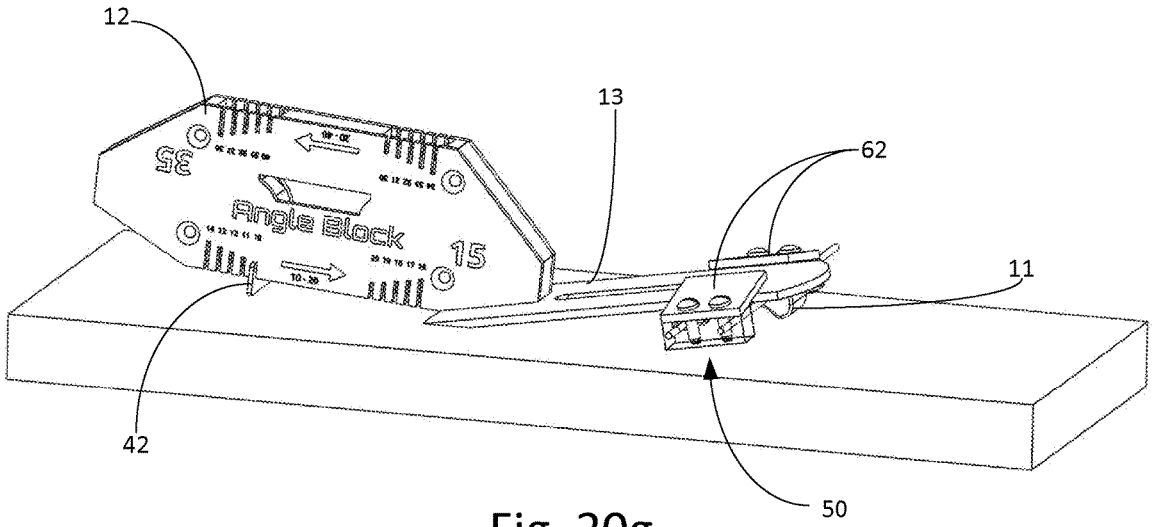
FIG. 20*g* shows a perspective view of a cutting tool positioned on the low-profile honing guide and engaging the angle reference block with the key set to a desired angle according to the present invention; and, FIG. 20*h* shows a perspective view of a cutting tool positioned on the low-profile honing guide and engaging the angle reference block according to the present invention.
Figure 20H:
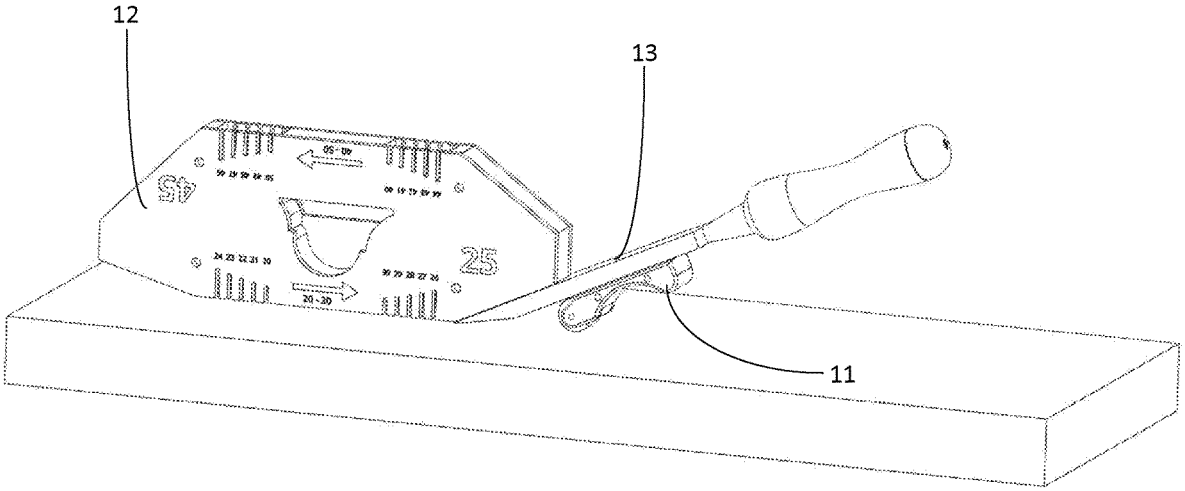

Referring to FIGS. 20*g* and 20*h*, prior to sharpening, the user must first set the angle of the blade 13 on the low-profile honing guide 11. Using the low-profile honing guide 11 in conjunction with angle reference block 12 set at a specific angle as detailed herein above, the blade can be quickly and repeatedly set at the same exact angle with little effort. The blade is simply positioned against the desired angled end surfaces 36*a*, 36*b*, 36*c* and 36*d* (FIG. 12) and pressed flat against gripping material 22 on flat top surface 20 of low-profile honing guide 11. Referring to FIG. 20*h*, in this arrangement with a chisel, since the blade is held to the guide by using only hand pressure, there is no need for mechanical adjusting and clamping for chisel type tools and narrow blades, which provides for an efficient and repeatable assisted freehand sharpening arrangement. Further, since the blade 13 is held against the honing guide 11 by only hand pressure, as a general rule, if the user can hold the blade in their hand, the honing guide of the present invention should be able to accommodate the tool for sharpening in the repeatable assisted freehand arrangement. With the exception of some short blades (spoke shave blades and knives) this sharpening system will work with almost any bench chisel, mortising chisel and hand plane blades. Referring to FIG. 20*g*, in this arrangement the clamp 50 is included on low-profile honing guide 11 to assist with securing a wide flat plane blade to the gripping material 22 on the top flat surface 20. The blade 13 is simply positioned against the desired angled end surfaces 36*a*, 36*b*, 36*c* and 36*d* (FIG. 12) to set the sharpening angle, and then the clamp arms 56 engaged against the blade 13 to hold it in position during the sharpening process.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. A tool sharpening system comprising:

a sharpening stone having a level surface;

an angle reference block including a series of angled end surfaces;

a series of slots disposed in a body of said angle reference block, wherein each of said slots includes a stop member that extends upward from a bottom of the slot a given distance that is associated with a specific angle set point;

a key being receivable in said slots to adjust the angle associated with said angled end surfaces, wherein each said slot designates a predefined angle for adjusting the angled end surfaces to a desired set angle when said key is disposed in a given said slot and placed on the level surface of the sharpening stone;

a honing guide having a housing that rotatably carries a roller member;

a flat top surface disposed on a top side of said housing;

a gripping material disposed on said flat top surface for receiving and resisting movement of a blade of a hand tool disposed against said flat top surface;

whereby the blade of the hand tool is positionable against said angled end surfaces of said angle reference block while disposed on said flat top surface of said honing guide to set a sharpening angle, and said honing guide with said blade is then movable on the level surface of the sharpening stone for assisted freehand sharpening of the blade at the set angle.

2. The tool sharpening system of claim 1 wherein said roller member comprises a roller ring.

3. The tool sharpening system of claim 2 wherein said roller ring is carried in a raceway defined in said housing, and wherein a bottom portion of said housing further defines a section of said raceway and provides a finger brace against which a user's finger rest during use.

4. The tool sharpening system of claim 3 wherein at least one bearing unit is disposed along a top side of said raceway and engages said roller ring.

5. The tool sharpening system of claim 4 including a bearing access opening disposed in said housing adjacent said at least one bearing unit that exposes a portion of the bearing unit for cleaning and oiling.

6. The tool sharpening system of claim 2 wherein said roller ring includes a textured surface on an outer surface of the ring to help grip on a sharpening surface of the sharpening stone and facilitate rolling.

7. The tool sharpening system of claim 2 wherein said roller ring includes a radiused outer surface to allow for lateral pivoting on a sharpening surface of the sharpening stone to help shift pressure to a given portion of a cutting edge of the blade during sharpening.

8. The tool sharpening system of claim 1 wherein said housing includes a long side and a short side relative to a center axis extending through a diameter of said roller member, wherein a cutting edge of the blade is positioned to extend outwardly from either said long side or said short side based on a given angle of sharpening.

9. The tool sharpening system of claim 1 including a honing guide recess defined in the body of said angle reference block that has a complementary shape to the exterior of said honing guide for receiving said honing guide when not in use; and, a key recess defined in the body of said angle reference block that has a complementary shape to the exterior of said key for receiving said key when not in use.

10. The tool sharpening system of claim 9 including at least one magnet carried in a magnet slot disposed in said key recess for engaging said key and resisting accidental removal of said key from said key recess.

11. The tool sharpening system of claim 1 wherein a concaved arched bottom side is included in said housing for receiving a user's finger.

12. The tool sharpening system of claim 11 including a pair of roller arms extend laterally outward below a horizontal plane of said flat top surface;

wherein said roller member is rotatably carried between the roller arms;

wherein an apex of the roller member is approximately level with said horizontal plane of said flat top surface; and, wherein the blade mounted to said honing guide is vertically spaced from the apex of said roller member by said gripping material disposed on said flat top surface.

13. The tool sharpening system of claim 12 wherein said roller member comprises a cylindrically shaped roller.

14. The tool sharpening system of claim 1 including a clamp removably carried by said housing, said clamp including:

at least one guide rod opening disposed in said housing and passing completely through said housing;

at least one guide rod received in and extending through said at least one guide rod opening, wherein said guide rod extends laterally outward from said housing below said flat top surface;

a first clamping arm carried by said at least one guide rod on a first side of said housing and movable along said guide rod;

a second clamping arm carried by said at least one guide rod on a second side of said housing opposite said first side and movable along said guide rod;

said first and the second clamping arms each including a securing arm portion extending at an inclined upward angle above a horizontal plane of said flat top surface;

whereby the blade of the hand tool is receivable against said gripping material of said flat top surface and said clamping arms are movable along said guide rod to engage said blade and press said blade downward against said gripping material on said flat top surface of said housing.

15. A honing guide for a tool sharpening system, said honing guide comprising:

a housing having a flat top surface;

a gripping material carried by said flat top surface;

a roller member rotatably carried by said housing;

at least one guide rod opening disposed in said housing and passing completely through said housing;

a clamp removably carried by said housing, said clamp including:

at least one guide rod received in and extending through said at least one guide rod opening, wherein said guide rod extends laterally outward from said housing below said flat top surface;

a first clamping arm carried by said at least one guide rod on a first side of said housing and movable along said guide rod;

a second clamping arm carried by said at least one guide rod on a second side of said housing opposite said first side and movable along said guide rod;

said first and the second clamping arms each including a securing arm portion extending at an inclined upward angle above a horizontal plane of said flat top surface;

whereby a tool blade is receivable against said gripping material of said flat top surface and said clamping arms are movable along said guide rod to engage said tool blade and press said tool blade downward against said gripping material on said flat top surface of said housing.

16. The honing guide for a tool sharpening system of claim 15 wherein said roller member comprises a roller ring; wherein said roller ring is carried in a raceway defined in said housing; and, wherein a bottom portion of said housing further defines a section of said raceway and provides a finger brace against which a user's finger rest during use.

17. The honing guide for a tool sharpening system of claim 16 wherein said housing includes a long side and a short side relative to a center axis extending through a diameter of said roller ring, wherein a cutting edge of the tool blade is positioned to extend outwardly from either said long side or said short side based on a given angle of sharpening.

18. The honing guide for a tool sharpening system of claim 15 wherein a concaved arched bottom side is included in said housing for receiving a user's finger.

19. The honing guide for a tool sharpening system of claim 18 including a pair of roller arms extend laterally outward below a horizontal plane of said flat top surface;

wherein said roller member is rotatably carried between the roller arms;

wherein an apex of the roller member is approximately level with said horizontal plane of said flat top surface; and, wherein the blade mounted to said honing guide is vertically spaced from the apex of said roller member by said gripping material disposed on said flat top surface.

20. A honing guide for a tool sharpening system, said honing guide comprising:

a housing rotatably carrying a roller ring;

a flat top surface disposed on a top side of said housing;

a gripping material disposed on said flat top surface for receiving and resisting movement of a blade disposed against said flat top surface;

wherein said housing includes a long side and a short side relative to a center axis extending through a diameter of said roller ring, wherein the cutting edge of the blade is positioned to extend outwardly from either said long side or said short side based on a given angle of sharpening;

wherein said roller ring is carried in a raceway defined in said housing, and wherein a bottom portion of said housing further defines a section of said raceway and provides a finger brace against which a user's finger rest during use; and, at least one bearing unit disposed along a top side of said raceway and engaging said roller ring.

* * * * *